US005418100A

United States Patent [19]

Yu

[11] Patent Number: 5,418,100

[45] Date of Patent: May 23, 1995

[54] CRACK-FREE ELECTROPHOTOGRAPHIC IMAGING DEVICE AND METHOD OF MAKING SAME

[75] Inventor: Robert C. U. Yu, Webster, N.Y.

[73] Assignee: Xerox Corporation, Stamford, Conn.

[21] Appl. No.: 232,314

[22] Filed: Apr. 25, 1994

Related U.S. Application Data

[63] Continuation of Ser. No. 545,831, Jun. 29, 1990, abandoned.

[51] Int. Cl.[6] ..... G03G 15/00

[52] U.S. Cl. ..... 430/58; 430/56; 430/57

[58] Field of Search ..... 430/56, 57, 58

[56] References Cited

U.S. PATENT DOCUMENTS

| | | | |
|---|---|---|---|
| 3,357,989 | 12/1967 | Byrne et al. | 260/314.5 |
| 3,403,019 | 9/1968 | Stahly et al. | 96/1.5 |
| 3,442,781 | 5/1969 | Weinberger | 204/181 |
| 3,713,821 | 1/1973 | Angelini | 96/1.5 |
| 4,173,472 | 11/1979 | Berwick et al. | 96/1.5 |
| 4,265,990 | 5/1981 | Stolka et al. | 430/59 |
| 4,286,033 | 8/1981 | Neyhart et al. | 430/58 |
| 4,291,110 | 9/1981 | Lee | 430/59 |
| 4,338,387 | 7/1982 | Hewitt | 430/58 |
| 4,381,337 | 4/1983 | Chang | 430/58 |
| 4,587,189 | 5/1986 | Hor et al. | 430/59 |
| 4,637,971 | 1/1987 | Takei et al. | 430/59 |
| 4,654,284 | 3/1987 | Yu et al. | 430/59 |
| 4,664,995 | 5/1987 | Horgan et al. | 430/59 |
| 4,760,008 | 7/1988 | Yamazaki et al. | 430/127 |
| 4,758,488 | 7/1988 | Johnson et al. | 430/59 |
| 4,786,570 | 11/1988 | Yu et al. | 430/58 |
| 4,806,443 | 2/1989 | Yanus et al. | 430/56 |
| 4,840,861 | 6/1989 | Staudenmayer et al. | 430/59 |
| 4,853,307 | 8/1989 | Tam et al. | 430/41 |
| 4,855,201 | 8/1989 | Badesha et al. | 430/58 |
| 4,925,760 | 5/1990 | Baranyi et al. | 430/128 |
| 5,094,930 | 3/1992 | Nomori et al. | 430/58 |

*Primary Examiner*—S. Rosasco
*Attorney, Agent, or Firm*—Oliff & Berridge

[57] ABSTRACT

In an electrophotographic imaging device, the solvent used to coat charge transport materials is a solvent to which an underlying adhesive layer is substantially insensitive. The adhesive layer may, for example, be formed of cross-linked film-forming polymers which are insoluble in a solvent used to apply the charge transport layer.

35 Claims, 1 Drawing Sheet

CRACK-FREE ELECTROPHOTOGRAPHIC IMAGING DEVICE AND METHOD OF MAKING SAME

This is a Continuation of application Ser. No. 07/545,831, filed Jun. 29, 1990, now abandoned.

BACKGROUND OF THE INVENTION

This invention relates in general to electrophotography and, in particular, to electrophotoconductive imaging members having multiple layers.

In electrophotography, an electrophotographic plate containing a photoconductive insulating layer on a conductive layer is imaged by first uniformly electrostatically charging its surface. The plate is then exposed to a pattern of activating electromagnetic radiation such as light. The radiation selectively dissipates the charge in the illuminated areas of the photoconductive insulating layer while leaving behind an electrostatic latent image in the non-illuminated areas. This electrostatic latent image may then be developed to form a visible image by depositing finely divided electroscopic marking particles on the surface of the photoconductive insulating layer. The resulting visible image may then be transferred from the electrophotographic plate to a support such as paper. This imaging process may be repeated many times with reusable photoconductive insulating layers.

An electrophotographic imaging member may be provided in a number of forms. For example, the imaging member may be a homogeneous layer of a single material such as vitreous selenium or it may be a composite layer containing a photoconductor and another material. One type of composite imaging member comprises a layer of finely divided particles of a photoconductive inorganic compound dispersed in an electrically insulating organic resin binder. U.S. Pat. No. 4,265,990 discloses a layered photoreceptor having separate photogenerating and charge transport layers. The photogenerating layer is capable of photogenerating holes and injecting the photogenerated holes into the charge transport layer.

U.S. Pat. No. 4,758,488 to Johnson et al discloses a photoresponsive imaging member comprising a hole transporting layer comprised of a polysilylene stabilized with a component possessing an ionization potential equal to or greater than the polysilylene. The stabilized polysilylenes allow for the prevention of cracking of the imaging member.

U.S. Pat. No. 4,855,201 to Badesha et al discloses photoconductive imaging members with electron transporting polysilylenes. The polysilylene polymer is coated with a solvent such as benzene, or toluene. An optional adhesive layer may also be applied from a solvent solution of tetrahydrofuran, toluene and methylene chloride.

U.S. Pat. No. 4,853,307 to Tam et al discloses a copolymer comprised of styrene and ethyl acrylate contained in an adhesive layer.

U.S. Pat. No. 4,806,443 to Yanus et al discloses a polyether/polycarbonate contained in an electrophotoconductive layer. The imaging member may further comprise an adhesive layer containing a polyester resin. Any suitable solvent may be employed to apply the charge transport layer material.

U.S. Pat. No. 4,637,971 to Takei discloses a photoreceptor having a photosensitive layer containing a polycarbonate compound binder. An interlayer which may function as an adhesion layer may be included comprising high molecular weight materials such as polyurethane resin, polyester resin and the like.

As more advanced, higher speed electrophotographic copiers, duplicators and printers were developed, degradation of image quality was encountered during extended cycling. Moreover, complex, highly sophisticated duplicating and printing systems operating at very high speeds have placed stringent requirements including narrow operating limits on photoreceptors. Modern composite imaging members have been developed having numerous layers which are highly flexible and exhibit predictable electrical characteristics within narrow operating limits to provide excellent images over many thousands of cycles. One type of multilayered photoreceptor that has been employed as a belt in electrophotographic imaging systems comprises a substrate, a conductive layer, a blocking layer, an adhesive layer, a charge-generating layer, and a charge transport layer. This photoreceptor may also comprise additional layers such as an anti-curl layer and an optional overcoating layer.

During machine function, a photoconductive imaging member is constantly under repetitive electrophotographic cycling which subjects the electrically operative layers to high electrical charging/discharging cycles, multiple exposures to light for latent imaging development and erasure, and heat due to temperature elevation as a result of machine operation. This repetitive electrical and light fatigue lead to a gradual deterioration in the electrical characteristics of the imaging member, and limit its service life in the field. In the attempt to fabricate a robust photoconductive imaging system, many innovative ideas have been attempted with the intent to overcome this shortfall and extend the electrical functional life of the imaging member.

One of the most encouraging advances in photoconductive imaging development which has emerged in recent years is the successful fabrication of a novel design of a flexible imaging member which exhibits a nearly ideal capacitive charging characteristic, outstanding photosensitivity, low electrical potential dark decay, and long term electrical cyclic stability. This novel imaging member design employed in belt form comprises a substrate, a conductive layer, a solution coated hole blocking layer, a solution coated adhesive layer, a thin vacuum sublimation deposited charge generating layer of pure organic pigment, a solution extruded charge transport layer with an adjacent solution co-extruded ground strip at one edge of the imaging layers, a solution extruded anti-curl layer, and an optional overcoating layer. For example, U.S. Pat. No. 4,587,189 to Hor et al discloses photoconductive imaging members comprising a vacuum sublimation deposited benzimidazole perylene charge generating layer for photoelectric imaging performance enhancement.

This novel multilayered belt-imaging member provides excellent electrical properties and extended life, but is also seen to exhibit a major problem of charge generating layer mud-cracking. The observed charge generating layer mud-cracking consists of a two-dimensional network of cracks. Mud-cracking is believed to be the result of built-in internal stress due to the vacuum sublimation-deposition process and solvent penetration through the thin charge generating layer which dissolves the adhesive layer underneath during application of the charge transport layer solution. Cracking in the charge generating layer has a serious impact on the versatility of a photoreceptor and reduces its practical value. Charge generating layer cracking not only can print out as defects, but may also act as stress concentration centers which then propagate the cracks into the other electrically operative layer, i.e. the charge transport layer, during dynamic belt machine cycling.

While the above-mentioned imaging member gives the desirable electrical characteristic, there is an urgent need to resolve the cracking issue in order to make the imaging member design acceptable for product implementation. It is also important to emphasize that any solution employed to solve the charge generating layer mud-cracking problem should produce no deleterious effects on the electrical and mechanical integrities of the original device.

SUMMARY OF THE INVENTION

The present inventor has discovered an origin of the problem associated with the observed mud-cracking. Internal tensile stress is built up in the charge generating layer as a result of sublimation-deposition of this layer onto an adhesive layer in a multilayered imaging device. In particular, during the vacuum sublimation-deposition process, the organic pigment sublimes at a high temperature from a crucible and condenses onto an adhesive/-blocking layer/ground plane/polyester supporting substrate to form a thin charge generating layer of about 0.65 percent of the supporting substrate thickness. During this process, the charge generating layer remains at an elevated temperature and at a stress-free state. However, the temperature rise in the substrate is only slight since it has a much larger mass than the charge generating layer and since it is a good heat insulator. As the layers cool to ambient room temperature, the two-dimensional thermal contraction of the charge generating layer exceeds that of the substrate, thereby causing the development of internal stress in the charge generating layer.

Adhesives commonly used in the adhesive layer are highly soluble in methylene chloride, which is a common solvent for applying the charge transport coating solution. Although the sublimation deposited charge generating layer is insoluble to the solvent used to apply the charge transport layer, it is permeable to solvents used to apply the charge transport layer because it is desirably very thin. This permeability allows for solvent penetration through the thin charge generating layer during charge transport layer coating. It has been found that penetration of solvent through the charge generating layer can adversely affect the charge generating layer/adhesive layer interface bonding due to dissolution of the adhesive layer. Without the adhesive layer anchored support, the sublimation-deposited charge generating layer releases its planar internal stress, resulting in two-dimensional mud-cracking.

It is therefore an object of the invention to eliminate the charge generating layer mud-cracking problem by making the interfacial layer insensitive to solvent attack, and in particular, methylene chloride attack.

It is an object of the present invention to provide an adhesive layer comprising a cross-linked polymer which is insoluble to the solvent used to apply the charge transport layer.

It is yet another object of the invention to provide an adhesive layer comprising a cross-linked copolyester which is insensitive to the solvent used to apply the charge transport layer.

It is another object of the invention to provide an imaging member comprising a cross-linked polyurethane adhesive layer which is insensitive to the solvent used to apply the charge transport layer.

It is also an object of the invention to provide a materials combination for the layers in a multi-layered imaging device which overcomes the problems of the prior art.

It is an object of the invention to provide an electrophotographic imaging member comprising a charge transport layer which is coated on the device using a solvent which is a non-solvent to the material contained in the adhesive layer.

It is another object of the invention to provide binder materials for the charge transport layer which are soluble in solvents which do not adversely affect the adhesive layer/charge-generating layer bonding.

It is yet another object of the invention to provide an electrophotographic imaging member with improved charge generating layer resistance to mud-cracking.

It is a further object of the present invention to provide an improved electrophotographic imaging member which exhibits greater resistance to layer delamination.

These and other objects of the invention are provided by selection of materials to ensure that an adhesive layer is insensitive to the solvent used to apply the charge transport layer. The adhesive material may be a cross-linked polymer, for example, a cross-linked copolyester, a cross-linked polyurethane or a polyurethane latex. A method for fabricating the imaging member is also provided by using a specifically selected charge transport layer polymer binder that can utilize a solvent for applying the charge transport layer solution which does not affect the adhesive layer.

BRIEF DESCRIPTION OF THE DRAWINGS

A more complete understanding of the present invention can be obtained by reference to the accompanying FIG. 1 which is a cross-sectional view of a multi-layered photoreceptor of the invention.

DESCRIPTION OF PREFERRED EMBODIMENTS

Figure 1:
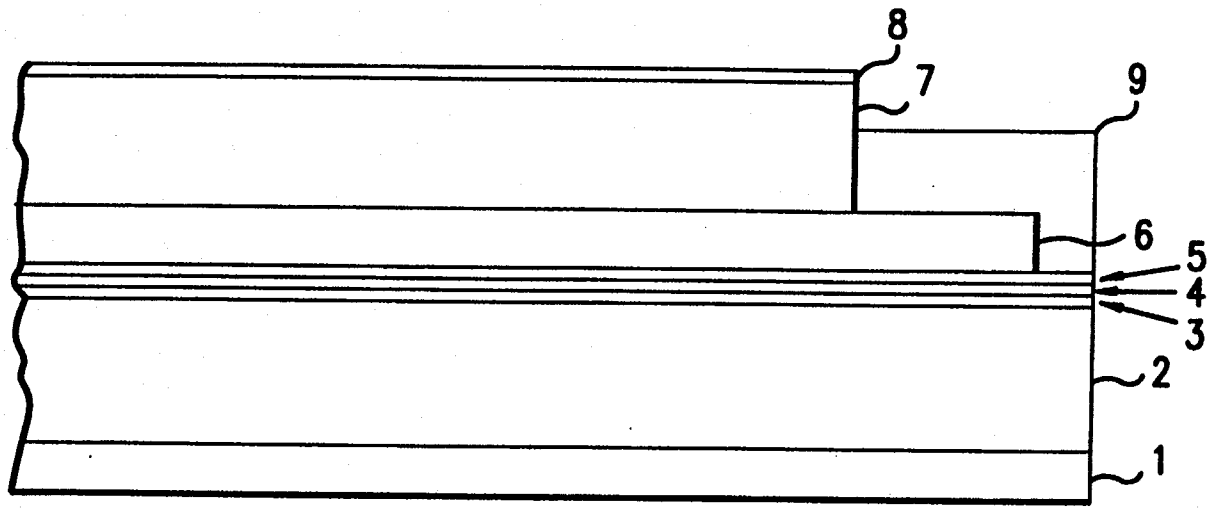

In one embodiment of the electrophotographic imaging member according to the present invention, a selection of materials is provided to ensure that an adhesive layer is substantially insensitive to solvent, preferably methylene chloride, used to apply the charge transport layer. The adhesive layer materials of the present invention may be cross-linked polymers.

In another embodiment of the present invention, specific material for the layers of the imaging device are provided. More specifically, binder materials are chosen which are soluble in a particular solvent, which solvent does not adversely affect adhesive layer/charge generating layer bonding.

For a better understanding of the preferred embodiments of the invention, reference will be made to a particular electrophotographic imaging member.

A representative structure of an electrophotographic imaging member is shown in FIG. 1. This imaging member is provided with an anti-curl layer 1, a supporting substrate 2, an electrically conductive ground plane 3, a hole blocking layer 4, an adhesive layer 5, a charge generating layer 6, and a charge transport layer 7. An optional overcoating layer 8 is also shown in FIG. 1.

In the above-described device, a ground strip 9 is preferably provided adjacent the charge transport layer at an outer edge of the imaging member. See U.S. Pat. No. 4,664,995. The ground strip 9 is coated adjacent to the charge transport layer so as to provide grounding contact with a grounding device (not shown) during electrophotographic processes.

A description of the layers of the electrophotographic imaging member of the present invention shown in FIG. 1 follows in connection with a first embodiment. In the first embodiment of the invention, a cross-linked adhesive layer is provided which is virtually insoluble in many solvents which may be used for charge transport layer coating solution preparations. In other words, the adhesive layer applied over the charge blocking layer is selected from a specific film former polymer which can be cross-linked, resulting in an adhesive layer which has excellent resistance to the attack by solvent used to apply the charge transport layer. The cross-linking process should eliminate the observed charge generating layer mud-cracking, provide good adhesion bonding, and produce no negative impact on the imaging member.

The Supporting Substrate

The supporting substrate 2 may be opaque or substantially transparent and may comprise numerous suitable materials having the required mechanical properties. The substrate may further be provided with an electrically conductive surface. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like. The electrically insulating or conductive substrate should be flexible and may have any number of different configurations such as, for example, a sheet, a scroll, an endless flexible belt, and the like. Preferably, the substrate is in the form of an endless flexible belt and comprises a commercially available biaxially oriented polyester known as Mylar, available from E. I. du Pont de Nemours & Co., or Melinex available from ICI Americas Inc.

The preferred thickness of the substrate layer depends on numerous factors, including economic considerations. The thickness of this layer may range from about 65 micrometers to about 150 micrometers, and preferably from about 75 micrometers to about 125 micrometers for optimum flexibility and minimum induced surface bending stress when cycled around small diameter rollers, e.g., 19 millimeter diameter rollers. The substrate for a flexible belt may be of substantial thickness, for example, over 200 micrometers, or of minimum thickness, for example less than 50 micrometers, provided there are no adverse effects on the final photoconductive device. The surface of the substrate layer is preferably cleaned prior to coating to promote greater adhesion of the deposited coating. Cleaning may be effected by exposing the surface of the substrate layer to plasma discharge, ion bombardment and the like.

The Electrically Conductive Ground Plane

The electrically conductive ground plane 3 may be an electrically conductive metal layer which may be formed, for example, on the substrate 2 by any suitable coating technique, such as a vacuum depositing technique. Typical metals include aluminum, zirconium, niobium, tantalum, vanadium, hafnium, titanium, nickel, stainless steel, chromium, tungsten, molybdenum, and the like, and mixtures thereof. The conductive layer may vary in thickness over substantially wide ranges depending on the optical transparency and flexibility desired for the electrophotoconductive member. Accordingly, for a flexible photoresponsive imaging device, the thickness of the conductive layer is preferably between about 20 Angstroms to about 750 Angstroms, and more preferably from about 50 Angstroms to about 200 Angstroms for an optimum combination of electrical conductivity, flexibility and light transmission.

Regardless of the technique employed to form the metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide as a transparent layer for light having a wavelength between about 4000 Angstroms and about 9000 Angstroms or a conductive carbon black dispersed in a plastic binder as an opaque conductive layer.

The Hole Blocking Layer

After deposition of the electrically conductive ground plane layer, the hole blocking layer 4 may be applied thereto. Electron blocking layers for positively charged photoreceptors allow holes from the imaging surface of the photoreceptor to migrate toward the conductive layer. For negatively-charged photoreceptors, any suitable hole blocking layer capable of forming a barrier to prevent hole injection from the conductive layer to the opposite photoconductive layer may be utilized. The hole blocking layer may include polymers such as polyvinylbutryral, epoxy resins, polyesters, polysiloxanes, polyamides, polyurethanes and the like, or may be nitrogen-containing siloxanes or nitrogen-containing titanium compounds such as trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylamino-ethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,338,387, 4,286,033 and 4,291,110. A preferred hole blocking layer comprises a reaction product of a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. The hydrolyzed silanes have the general formula

I

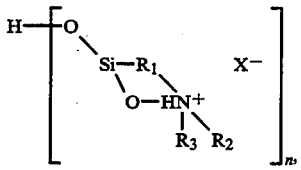

or

II

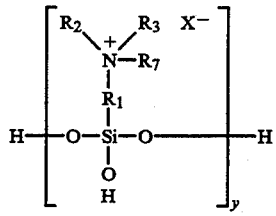

wherein $R_1$ is an alkylidene group containing 1 to 20 carbon atoms, $R_2$, $R_3$ and $R_7$ are independently selected from the group consisting of H, a lower alkyl group containing 1 to 3 carbon atoms and a phenyl group, X is an anion of an acid or acidic salt, n is 1–4, and y is 1–4. The imaging member is preferably prepared by depositing on the metal oxide layer of a metal conductive layer, a coating of an aqueous solution of the hydrolyzed aminosilane at a pH between about 4 and about 10, drying the reaction product layer to form a siloxane film and applying an adhesive layer, and thereafter applying electrically operative layers, such as a photogenerator layer and a hole transport layer, to the adhesive layer.

The hole blocking layer should be continuous and have a thickness of less than about 0.5 micrometer because greater thicknesses may lead to undesirably high residual voltage. A hole blocking layer of between about 0.005 micrometer and about 0.3 micrometer is preferred because charge neutralization after the exposure step is facilitated and optimum electrical performance is achieved. A thickness between about 0.03 micrometer and about 0.06 micrometer is preferred for hole blocking layers for optimum electrical behavior. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layer is preferably applied in the form of a dilute solution, with the solvent being removed after deposition of the coating by conventional techniques such as by vacuum, heating and the like. Generally, a weight ratio of hole blocking layer material and solvent of between about 0.05:100 to about 0.5:100 is satisfactory for spray coating.

The Adhesive Layer

Adhesives typically employed for adhesive layers in the prior art include copolyester Vitel PE-100, available from Goodyear Rubber Tire Co., and copolyester du Pont 49,000, available from E. I. du Pont de Nemours & Co., as disclosed in U.S. Pat. Nos. 4,587,189, 4,654,284 and 4,786,570. Unfortunately, these adhesive layers are highly soluble in methylene chloride, the common solvent used for charge transport layer solution preparation. Since the solubility of these adhesives in the solvent used to apply the charge transport layer facilitates the development of cracking, the present invention is directed to the use of cross-linked polymers which are substantially insensitive to solvents used to apply the charge transport layer. Since the cross-linking process is a chemical reaction which interconnects all the polymeric molecules into a three-dimensional network, the resulting fully cross-linked structure has in fact become essentially one single giant molecule, thereby making the material insoluble to all solvents. Particular cross-linked adhesive materials include, for example, cross-linked copolyesters and cross-linked polyurethanes. In addition to good adhesion results and the elimination of charge generating layer mud-cracking, the adhesive layer formulations of the present invention produce no adverse electrical impacts. For example, characteristic electricals unique to a sublimation-deposited benzimidazole perylene photoreceptor after 50,000 cyclic cycling are maintained.

The cross-linked copolyesters of the present invention may be any cross-linked copolyester which is substantially insensitive to methylene chloride attack. For example, the cross-linked copolyesters of the present invention may include Vitel copolyester resins which may be obtained from Goodyear Rubber & Tire Co. as short-chain branched molecules having cross-linkable hydroxy functionalities. Unlike a long chain linear molecule that has only two hydroxy terminals, the short chain branched molecular structure provides many more reactive hydroxy sites to facilitate a higher degree of cross-linking density in the resulting material. These copolyesters are chemically similar to 49,000 from du Pont as they have isophthalate, terephthalate, and glycols in their molecular chain backbones. The cross-linking of these materials may be obtained by use of cross-linking agents.

Du Pont 49,000 is a linear saturated copolyester of four diacids and ethylene glycol having a molecular weight of about 70,000. Its molecular structure is represented as $$HO-\overset{\overset{\displaystyle O}{\|}}{C}-[\text{Diacid-Ethylene glycol}]_n-OH$$

where n is a number sufficient for achieving the molecular weight of about 70,000. The ratio of diacid to ethylene glycol in the copolyester is 1:1. The diacids are terephthalic acid, isophthalic acid, adipic acid and azelaic acid in a ratio of 4:4:1:1.

In contrast to the du Pont 49,000, the copolyesters of the present invention contain less than about 1,500 carbon atoms and contain about 0.2 hydroxy group per repeating unit.

Copolyesters which may be used in the present invention include, for example, Vitel PE-5545, Vitel PE-5571, and Vitel PE-5824, available from Goodyear, cross-linked with a cross-linker. Other materials include Goodyear Vitel PE-307 and Vitel PE-5833, cross-linked with a cross-linker.

Cross-linking agents which may be added to the Vitel copolyester adhesives include, for example, triisocyanates such as Mondur CB-75 and Desmodur N-75 available from Mobay, to facilitate cross-linking. Further cross-linkers include, for example, American Cyanamid Cymel 300, Cymel 301 and Cymel 303. Cross-linking of du Pont 49,000 to make the coated adhesive interlayer insensitive to solvent attack may be possible by addition of RC-803, an aromatic polyisocyanate and toluene diisocyanate blend available from E. I. du Pont de Nemours & Co., to the coating solution.

Cross-linked polyurethanes which are insoluble in the solvent used for charge transport layer coating, for example, methylene chloride, may also be used as the adhesive layer. Cross-linked polyurethanes may be obtained from the reaction of a polyol prepolymer with stoichiometric amounts of diisocyanate dissolved in toluene. Cross-linkable polyurethane systems include Krystalgard aliphatic polyurethanes KR-4780, KR-4781, KR-4783 and KR-4800, available from K. P. Quinn & Co., Inc. These systems can conveniently be diluted with toluene, tetrahydrofuran (THF) or any other suitable solvent, to any concentration to suit specific coating requirements. The cross-linking process of a casted polyurethane film is auto-catalyzed by airborne moisture to form a three-dimensional insoluble cross-linked network. Completion of the cross-linking reaction may take less than two minutes at elevated temperatures of about 135° C. This characteristic is desirable for production coating application.

Other cross-linked polyurethane adhesives include, for example, Adcote 527/9L2 from Morton Chemicals; Amicon TU902 from Amicon; Arcon EU-630 from Allied Resin; Calthane 2300 from Cal Polymers; FP1216EP from Fluid Polymers; 3M3532 from 3M Corp.; M-CB75/R12A from Mobay; PG6000/6030, PG6600/6630, and PG6700/6730 from Ashland Chemicals; Halthane 73-18 and Halthane 88-2 from BKC; and Tyrite from Hughson Chemicals. Commercially available polyurethane latexes may also be used in the adhesive layer.

The thickness of the dry cross-linked polyurethane or polyester adhesive layer preferably ranges from about 0.01 micrometer to about 0.3 micrometer, more preferably from about 0.04 micrometer to about 0.15 micrometer.

The Charge Generating Layer

Any suitable charge generating (photo-generating) layer 6 may be applied to the adhesive layer 5 which layer 6 can then be coated over with a contiguous hole transport layer. Examples of materials out of which photogenerating layers can be vacuum sublimation deposited include photoconductive perylene and phthalocyanine pigments, for example, benzimidazole perylene and chloro indium phthalocyanine. Other phthalocyanine pigments such as the X-form of metal free phthalocyanine described in U.S. Pat. No. 3,357,989, and metal phthalocyanines in the forms of vanadyl phthalocyanine, titanyl phthalocyanine and copper phthalocyanine are also included. Other pigments of interest include, for example, dibromoanthanthrone; squarylium; quinacridones such as those available from du Pont under the tradename Monastral Red, Monastral Violet and Monastral Red Y; dibromo anthanthrone pigments such as those available under the trade names Vat orange 1 and Vat orange 3; substituted 2,4-diamino-triazines disclosed in U.S. Pat. No. 3,442,781; polynuclear aromatic quinones such as those available from Allied Chemical Corporation under the tradenames Indofast Double Scarlet, Indofast Violet Lake B, Indofast Brilliant Scarlet and Indofast Orange; and the like. Multi-photogenerating layer compositions may be utilized where a photoconductive layer enhances or reduces the properties of the photogenerating layer. Other suitable photogenerating materials known in the art and which can be vacuum sublimation deposited may also be utilized, if desired. Charge generating layers comprising a photoconductive material such as vanadyl phthalocyanine, metal free phthalocyanine, benzimidazole perylene, and the like and mixtures thereof are especially preferred because of their sensitivity to white light. However, chloro indium phthalocyanine, vanadyl phthalocyanine, and metal free phthalocyanine are also preferred because these materials provide the additional benefit of being sensitive to infrared light.

The charge generating layer may be applied by any sublimation-deposition process. Use of a vacuum sublimation-deposition process is desirable to obtain a thin charge generating layer without the need of a polymer binder. Thin charge generating layers are desirable because they permit intimate pigment-to-pigment contact and provide a shorter charge carrier traveling path to reach the charge transport layer for efficient electrophotographic imaging process enhancement. Charge generating layers which contain 50 percent by volume pigment dispersed in a binder as described, for example, in U.S. Pat. No. 3,121,006, need to be twice as thick as a sublimation deposited one. However, permeability to solvents is more apparent with the thin charge generating layers, which, though insoluble in the solvents, may destroy the interfacial bonding between the adhesive layer and charge generating layer, leading to the release of the charge generating layer's planar internal stress, and thereby resulting in mud-cracking.

The Charge Transport Layer

The charge transport layer 7 may comprise any suitable transparent organic polymer or non-polymeric material capable of supporting the injection of photogenerated holes and electrons from the charge-generating layer 6 and allowing the transport of these holes or electrons through the organic layer to selectively discharge the surface charge. The charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, e.g. 4000 Angstroms to 9000 Angstroms. The charge transport layer is substantially transparent to radiation in a region in which the photoconductor is to be used. It is comprised of a substantially non-photoconductive material which supports the injection of photogenerated holes from the charge-generating layer. The charge transport layer is normally transparent when exposure is effected therethrough to ensure that most of the incident radiation is utilized by the underlying charge-generating layer. When used with a transparent substrate, imagewise exposure or erase may be accomplished through the substrate with all light passing through the substrate. In this case, the charge transport material need not transmit light in the wavelength region of use. The charge transport layer in conjunction with the charge generating layer is an insulator to the extent that an electrostatic charge placed on the charge transport layer is not conducted in the absence of illumination.

The charge transport layer may comprise activating compounds dispersed in normally electrically inactive polymeric materials for making these materials electrically active. These compounds may be added to polymeric materials which are incapable of supporting the injection of photogenerated holes and incapable of allowing the transport of these holes. An especially preferred transport layer employed in multilayer photoconductors comprises from about 25 percent to about 75 percent by weight of at least one charge-transporting aromatic amine compound, and about 75 percent to about 25 percent by weight of a polymeric film-forming resin in which the aromatic amine is soluble.

The charge transport layer is preferably formed from a mixture comprising an aromatic amine compound of one or more compounds having the general formula:

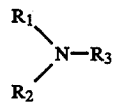

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl groups having from 1 to 18 carbon atoms and cycloaliphatic compounds having from 3 to 18 carbon atoms. The substituents should be free from electron-withdrawing groups such as $NO_2$ groups, CN groups, and the like. Typical aromatic amine compounds that are represented by this structural formula include:

I. Triphenyl amines such as:

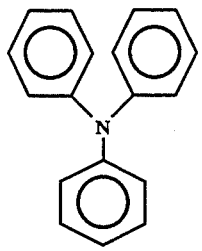

II. Bis and poly triarylamines such as:

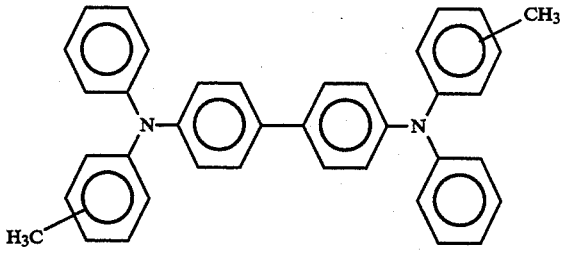

III. Bis arylamine ethers such as:

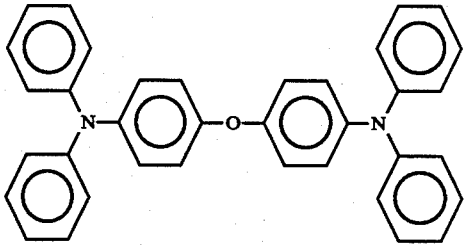

and

IV. Bis alkyl-arylamines such as:

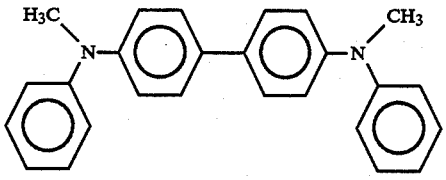

A preferred aromatic amine compound has the general formula:

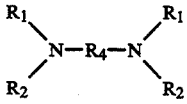

wherein $R_1$, and $R_2$ are defined above and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms. The substituents should be free from electron-withdrawing groups such as $NO_2$ groups, CN groups, and the like.

Examples of charge-transporting aromatic amines represented by the structural formulae above include triphenylmethane, bis(4-diethylamine-2-methylphenyl)-phenylmethane; 4-4'-bis(diethylamino)-2,2'-dimethyltriphenylmethane, N,N'-bis(alkylphenyl)-(1,1'-biphenyl)-4,4'-diamine wherein the alkyl is, for example, methyl, ethyl, propyl, n-butyl, etc., N,N'-diphenyl-N,N'-bis(3-methylphenyl)-(1,1'biphenyl)-4,4'-diamine, and the like, dispersed in an inactive resin binder.

Any suitable inactive resin binder soluble in methylene chloride or other suitable solvents may be employed since the material used in the adhesive layer is cross-linked and insensitive to attack by the solvent used for charge transport layer solution preparation. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 1,500,000. Other solvents that may dissolve these binders include tetrahydrofuran, toluene, trichloroethylene, 1,1,2-trichloroethane, 1,1,1-trichloroethane, and the like.

The preferred electrically inactive resin materials are polycarbonate resins having a molecular weight from about 20,000 to about 120,000, more preferably from about 50,000 to about 100,000. The materials most preferred as the electrically inactive resin material are poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from General Electric Company; Makrolon, a polycarbonate resin having a molecular weight of from about 50,000 to about 100,000, available as Makrolon from Farbenfabricken Bayer A. G.; Merlon, a polycarbonate resin having a molecular weight of from about 20,000 to about 50,000, available as Merlon from Mobay Chemical Company; polyether carbonates; and 4,4'-cyclohexylidene diphenyl polycarbonate. Methylene chloride is the preferred solvent for the charge transport layer coating solution preparation because it is adequate to dissolve all the material components and for its low boiling point to ease the wet coating drying after application over the charge generating layer. An adhesive layer material chosen from the present invention is a three-dimensional cross-linked polymer network which is insoluble and insensitive to the methylene chloride attack during charge transport layer coating.

The thickness of the charge transport layer may range from about 10 micrometers to about 50 micrometers, and preferably from about 20 micrometers to about 35 micrometers. Optimum thicknesses may range from about 23 micrometers to about 31 micrometers.

The Ground Strip

The ground strip 9 may comprise a film-forming polymer binder and electrically conductive particles. Cellulose may be used to disperse the conductive particles. Any suitable electrically conductive particles may be used in the electrically conductive ground strip layer 9 of this invention. The ground strip 9 may comprise materials which include those enumerated in U.S. Pat. No. 4,664,995. Typical electrically conductive particles include carbon black, graphite, copper, silver, gold, nickel, tantalum, chromium, zirconium, vanadium, niobium, indium tin oxide and the like. The electrically conductive particles may have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles throughout the matrix of the dried ground strip layer. The concentration of the conductive particles to be used in the ground strip depends on factors such as the conductivity of the specific conductive particles utilized.

The ground strip layer may have a thickness from about 7 micrometers to about 42 micrometers, and preferably from about 14 micrometers to about 27 micrometers.

The Anti-Curl Layer

The anti-curl layer 1 is optional, and may comprise organic polymers or inorganic polymers that are electrically insulating or slightly semi-conductive. The anti-curl layer provides flatness and/or abrasion resistance.

Anti-curl layer 1 may be formed at the back side of the substrate 2, opposite to the imaging layers. The anti-curl layer may comprise a film-forming resin and an adhesion promoter polyester additive. Examples of film-forming resins include polyacrylate, polystyrene, poly(4,4'-isopropylidene diphenyl carbonate), 4,4'-cyclohexylidene diphenyl polycarbonate, and the like. Typical adhesion promoters used as additives include 49,000 (du Pont), Vitel PE-100, Vitel PE-200, Vitel PE-307 (Goodyear), and the like. Usually from about 1 to about 15 weight percent adhesion promoter is selected for film-forming resin addition. The thickness of the anti-curl layer is from about 3 micrometers to about 35 micrometers, and preferably about 14 micrometers.

The Overcoating Lay

The optional overcoating layer 8 may comprise organic polymers or inorganic polymers that are electrically insulating or slightly semi-conductive. The overcoating layer may range in thickness from about 2 micrometers to about 8 micrometers, and preferably from about 3 micrometers to about 6 micrometers. An optimum range of thickness is from about 3 micrometers to about 5 micrometers.

In a second embodiment of the invention, an electrophotographic imaging member is provided having essentially the same materials described above for the supporting substrate 2, electrically conductive ground plane 3, charge blocking layer 4, charge generating layer 6, ground strip layer 9, anti-curl layer 1, and optional overcoating layer 8, with the exception of the selection of materials for the adhesive layer 5 and the charge transport layer 7. In particular, a selection of materials for the adhesive layer 5 and the charge transport layer 7 is made such that the film forming polymer binder used for the charge transport layer coating solution preparation requires a solvent which does not dissolve or attack the adhesive layer. The electrophotographic imaging member thus fabricated provides good adhesion and maintains the electrical integrity as well.

In this embodiment of the invention, film forming polymers for the adhesive layer 5 are chosen based on their insolubility in the solvent, for example toluene, used to apply the charge transport layer. The adhesive layer may be a single layer copolyester, for example, of Vitel PE-100, Vitel PE-200, Vitel-200D, Vitel PE-222, Vitel VPE-5571A, Vitel VPE-5833A, Vitel VPE-5987A, Flexclad VPE-4670A, Flexclad VPE-5253C, or Flexclad VPE-6402B. The Vitel and Flexclad copolyesters are available from Goodyear Rubber & Tire Co. Otherwise, single layer polymer blends may be used, such as Makrolon and Vitel PE-100; Makrolon and Vitel PE-200; Lexan and Vitel PE-100; Lexan and Vitel PE-200; Merlon and Vitel PE-100; Merlon and Vitel PE-200; and Makrolon and 10–30 weight percent N,N'-diphenyl-N,N'-bis(3-methylphenyl)-(1,1'biphenyl)-4,4'-diamine Multiple layer adhesives may also be used, for example, Makrolon/Vitel PE-100, Makrolon/Vitel PE-200, Makrolon/du Pont 49,000; Lexan/Vitel PE-100, Lexan/PE-200 and Lexan/du Pont 49,000; and Merlon/Vitel PE-100, Merlon/Vitel PE-200 and Merlon/du Pont 49,000. With the multiple layers, a first layer is formed on the blocking layer, and a second layer is formed on the first layer. The first layer provides good adhesion to the silane blocking layer. The second layer should be insoluble in the solvent used to apply the charge transport layer, and adhere well to the charge generating layer. The thickness of the Vitel copolyester or du Pont 49,000 first layer may range from about 0.01 to about 0.03 micrometer, and is applied directly over the hole (charge) blocking layer. The thickness of the second layer containing, for example, Makrolon or Lexan may range from about 0.12 micrometer to about 0.05 micrometer, and is applied over the first layer to form a double layer adhesive coating. The total double layer adhesive thickness should not exceed about 0.15 micrometer in order to give optimum electrical results.

The charge transport layer 7 of this embodiment has the same electrophotographic and mechanical functions as described in the first embodiment, except that a binder is used which is soluble in a solvent which does not dissolve or attack the materials employed in the adhesive layer. In particular, a solvent such as toluene may be used with a binder such as 4,4'-cyclohexylidene diphenyl polycarbonate, available from Mitsubishi Chemicals. The selection of the polymer binder in this embodiment is based on its compatibility with the charge transport active molecules and its solubility in the solvent such as toluene for charge transport layer coating solution preparation.

The present invention has been described for eliminating charge generating layer mud-cracking and improving adhesion strength by a first embodiment where a cross-linked adhesive layer is provided which is insensitive to solvent attack, and a second embodiment where a particular combination of materials is chosen for the adhesive layer and the charge transport layer. The invention will further be illustrated in the following, non-limiting examples, it being understood that these examples are intended to be illustrative only and that the invention is not intended to be limited to the materials, conditions, process parameters and the like recited herein.

COMPARATIVE EXAMPLE I

A photoconductive imaging member is prepared by providing a web of titanium coated polyester (Melinex, available from ICI Americas Inc.) substrate having a thickness of 3 mils, and applying thereto, with a gravure applicator using a production coater, a solution containing 50 grams 3-amino-propyltriethoxysilane, 15 grams acetic acid, 684.8 grams of 200 proof denatured alcohol and 200 grams heptane. This layer is then dried for about 5 minutes at 135° C. in the forced air drier of the coater. The resulting blocking layer has a dry thickness of 0.05 micrometer.

An adhesive interface layer is then prepared by the applying a wet coating over the blocking layer, using a gravure applicator, containing 0.5 percent by weight based on the total weight of the solution of copolyester adhesive (du Pont 49,000, available from E. I. du Pont de Nemours & Co.) in a 70:30 volume ratio mixture of tetrahydrofuran/cyclohexanone. The adhesive interface layer is then dried for about 5 minutes at 135° C. in the forced air drier of the coater. The resulting adhesive interface layer has a dry thickness of 620 Angstroms.

A 9 inches×12 inches sample is then cut from the web, and a 0.7 micrometer thickness benzimidazole perylene charge generating pigment is vacuum sublimation deposited over the du Pont 49,000 adhesive layer from a heated crucible. The sublimation-deposition process is carried out in a vacuum chamber under about $4\times10^{-5}$ mm Hg pressure and a crucible temperature of about 550° C.

This benzimidazole perylene coated member is removed from the vacuum chamber and overcoated with a charge transport layer. The charge transport layer coating solution is prepared by introducing into an amber glass bottle in a weight ratio of 1:1 N,N'-diphenyl-N,N'-bis (3-methylphenyl)-1,1'-biphenyl-4,4'-diamine and Makrolon 5705, a polycarbonate resin having a molecule weight of about 100,000 and commercially available from Farbenfabricken Bayer A. G. The resulting mixture is dissolved by adding methylene chloride to the glass bottle to form a 16 percent weight solid charge transport layer solution. This solution is applied onto the photo-generator layer by hand coating using a 3 mil gap Bird applicator to form a wet coating which upon drying at 135° C. in a forced air oven for 6 minutes gives a dried charge transport layer thickness of 24 micrometers.

During the charge transport layer coating process, the humidity is controlled at or less than 15 percent.

After the charge transport layer coating, the imaging member exhibits spontaneously upward curling. An anti-curl coating is needed to render the imaging member the desired flatness. The anti-curl coating solution is prepared in a glass bottle by dissolving 8.82 grams polycarbonate (Makrolon 5705, available from Bayer AG) and 0.09 grams copolyester adhesion promoter (Vitel PE-100, available from Goodyear Tire and Rubber Company) in 90.07 grams methylene chloride, The glass bottle is then covered tightly and placed on a roll mill for about 24 hours until total dissolution of the polycarbonate and the copolyester is achieved. The anti-curl coating solution thus obtained is applied to the rear surface of the supporting substrate (the side opposite to the imaging layers) of the photoreceptor device by hand coating using a 3 mil gap Bird applicator. The coated wet film is dried at 135° C. in an air circulation oven for about 5 minutes to produce a dry, 14 micrometers thick anti-curl layer.

EXAMPLE II

A photoconductive imaging member having two electrically operative layers (the charge generating and the charge transport layers) as described in COMPARATIVE EXAMPLE I is prepared using the same procedures, conditions, and materials except that the du Pont 49,000 adhesive layer is replaced by an adhesive layer comprised of a cross-linked copolyester.

An adhesive of the present invention is made by reacting 4 parts by weight of copolyester Vitel-PE 5545, available from Goodyear, with 1 part by weight Mondur CB-75, a crosslinker available from Mobay. The adhesive layer coating solution is prepared by dissolving 0.4 gram of copolyester Vitel PE-5545 in 99.5 grams 1,1,2 trichloroethane. Then, 0.1 gram of Mondur CB-75 crosslinker is added to the mixture to form a 0.5 weight percent solids of adhesive layer coating solution. This solution is then applied over the silane hole blocking layer by hand coating using a 0.5 mil gap Bird applicator and dried for 5 minutes at 135° C. in a forced air oven. A 408 Angstroms dry thickness fully cross-linked adhesive layer is obtained.

EXAMPLE III

The same procedure as described in Example II is followed to prepare a photoconductive imaging member, except an adhesive layer solution is made by reacting 4 parts by weight Vitel PE-5545 and with 2 parts by weight of Mondur CB-75. A 690 Angstroms dry thickness cross-linked adhesive layer is coated from the resulting solution.

EXAMPLE IV

The same procedure as described in Example II is followed to prepare a photoconductive imaging member, except an adhesive layer solution is made by reacting 4 parts by weight Vitel PE-5571, available from Goodyear, with 2 parts Mondur CB-75. A 680 Angstroms dry thickness cross-linked adhesive layer is coated from the resulting solution.

EXAMPLE V

The same procedure as described in Example II is followed to prepare a photoconductive imaging member, except an adhesive layer solution is made by reacting 2 parts by weight Vitel PE-5545 and 2 parts by weight Vitel PE-5571 with 2 parts by weight Mondur CB-75. A 650 Angstroms dry thickness cross-linked adhesive layer is coated from the resulting solution.

EXAMPLE VI

The same procedure as described in Example II is followed to prepare a photoconductive imaging member, except an adhesive layer solution is prepared by reacting 2 parts by weight Vitel PE-5545 and 2 parts by weight Vitel PE-5571 with 2 parts by weight Desmodur N-75, a crosslinker available from Mobay. A 500 Angstroms dry thickness cross-linked adhesive layer is coated from the resulting solution.

EXAMPLE VII

A photoconductive imaging member having two electrically operative layers, the charge generating layer and the charge transport layer as described in comparative EXAMPLE I, is fabricating using the same procedures, conditions and materials, except that the du Pont 49,000 adhesive layer is replaced by an adhesive layer comprised of cross-linked polyurethane. The polyurethane is Q-Thane KR-4780, a humidity catalyzed aliphatic polyurethane system available from K. P. Quinn & Co. The polyurethane is a one-component, water-clear liquid consisting of 35 weight percent polyol and diisocyanate dissolved in toluene. An adhesive layer of the invention is prepared by diluting the liquid with toluene to a final solid concentration of 0.5 weight percent. This solution is then applied onto the silane hole blocking layer by hand coating using a 0.5 mil gap Bird applicator. The wet coating is dried for 5 minutes at 135° C. in a forced air oven. Upon drying at elevated temperature, the coating is auto-catalyzed by the moisture in the air to yield a 690 Angstroms thickness, fully cross-linked, polyurethane adhesive layer.

EXAMPLE VIII

The same procedure as described in EXAMPLE VII is followed to prepare a photoconductive imaging member except that the Q-thane KR-4780 is replaced by Krystalgard KR 4800, a humidity catalyzed aliphatic polyurethane system available from K. P. Quinn & Co. The dry cross-linked polyurethane adhesive layer is 720 Angstroms in thickness.

EXAMPLE IX

The photoconductive imaging members having the adhesive layers of the present invention are evaluated for 180° peel strength and examined for benzimadazole perylene charge generating layer mud-cracking.

The 180° peel strength is determined by cutting a minimum of five 0.5 inch×6 inches imaging member samples from each of Examples I through VIII. For each sample, the charge transport layer is partially stripped from the test imaging member sample with the aid of a razor blade and then hand peeled to about 3.5 inches from one end to expose part of the underlying charge generating layer. The test imaging member sample is secured with its charge transport layer surface toward a 1 inch×6 inches×0.5 inch aluminum backing plate with the aid of two sided adhesive tape. At this condition, the anti-curl layer/substrate of the stripped segment of the test sample can easily be peeled away 180° from the sample to cause the adhesive layer to separate from the charge generating layer. The end of the resulting assembly opposite to the end from which the charge transport layer is not stripped is inserted into the upper jaw of an Instron Tensile Tester. The free end of the partially peeled anti-curl/substrate strip is inserted into the lower jaw of the Instron Tensile Tester. The jaws are then activated at a 1 inch/min crosshead speed, a 2 inch chart speed and a load range of 200 grams to 180° peel the sample at least 2 inches. The load monitored with a chart recorder is calculated to give the peel strength by dividing the average load required for stripping the anti-curl layer by the width of the test sample.

The effect of using a cross-linkable adhesive layer for du Pont 49,000 substitution to resolve the charge generating layer mud-cracking problem is analyzed by examining each photoconductive imaging member with an optical transmission microscope at 100 times magnification. The results obtained for 180° peel strength measurement and mud-cracking examination are listed in Table I below:

TABLE I

| EXAMPLE | Peel Strength (gm/cm) | Mud-cracking |
|---|---|---|
| I (Control) | 6.2 | Yes |
| II | 11.4 | No |
| III | 11.2 | No |
| IV | 10.8 | No |
| V | 10.0 | No |
| VI | 9 5 | No |
| VII | 8.6 | No |
| VIII | 9.2 | No |

The above data show that using the cross-linked adhesive layers of the present; invention for du Pont 49,000 replacement not only can totally eliminate the charge generating layer mud-cracking problem due to their excellent resistance to methylene chloride attack, these alternate adhesive layers are seen to provide adhesion enhancement as well. It is also worth mentioning here that when the invention adhesion layer's thicknesses are increased to 1,200 Angstroms, a high peel strength of about 17 gm/cm is obtained.

EXAMPLE X

A photoconductive imaging member having two electrically operative layers, the charge generating and the charge transport layers, as described in COMPARATIVE EXAMPLE I is fabricated using the same procedures, conditions, and materials with the exception that the du Pont 49,000 adhesive layer is replaced by a copolyester Vitel PE-100 available from Goodyear and the charge transport layer is substituted by a single film forming polymer (phenyl methyl polysilylene). This polymer is synthesized in-house and has excellent hole transporting capability. The polysilylene is soluble in toluene, and allows the charge transport layer coating solution to be conveniently prepared in this solvent and the application of this charge transport layer over the charge generating layer is followed by using the same procedures as described in previous EXAMPLES. Since Vitel PE-100 is totally insoluble in toluene, the use of polysilylene as a charge transport layer should have no effect on the physical integrity of the Vitel PE-100 adhesive layer.

An adhesive layer is prepared by applying a wet coating over the silane hole blocking layer, using a 0.5 percent by weight solution of Vitel PE-100 dissolved in a 70:30 volume ratio mixture of tetrahydrofuran/cyclohexanone. The adhesive layer obtained after drying at 135° C. for about 5 minutes has a thickness of 680 Angstroms.

EXAMPLE XI

A photoconductive imaging member having two electrically operative layers as described in COMPARATIVE EXAMPLE I is fabricated except that Makrolon is replaced by 4,4'-cyclohexylidene diphenyl polycarbonate as the binder for the charge transport layer; methylene chloride is substituted by toluene as the solvent for charge transport layer coating solution preparation; and Vitel PE-100 is used as the adhesive layer instead of du Pont 49,000. The adhesive layer has a thickness of 680 Angstroms.

EXAMPLE XII

The same procedure as described in EXAMPLE XI is followed to prepare a photoconductive imaging member, except copolyester Vitel PE-200 available from Goodyear is used as the adhesive layer. Vitel PE-200 is selected for its insolubility in toluene. The adhesive layer's thickness is 670 Angstroms.

EXAMPLE XIII

The same procedure as described in EXAMPLE XI is followed to prepare a photoconductive imaging member, except Makrolon doped with 10 percent by weight N,N'-diphenyl-N,N'-bis(3-methlyphenyl)-1,1'-biphenyl-4,4'diamine is used to replace the Vitel PE-100 adhesive layer. Makrolon being insoluble in toluene is a good choice for adhesive layer substitution. The 10 percent by weight dopant is added to the Makrolon to promote adhesion to the silane blocking layer below. The adhesive layer is 715 Angstroms thick.

EXAMPLE XIV

The same procedure as described in EXAMPLE XI is followed to prepare a photoconductive imaging member except that a polymer blend of 92:8 weight ratio of Makrolon and Vitel PE-200 is used as the adhesive layer and coated using methylene chloride as solvent. The blending of Vitel PE-200 provides good adhesion bonding to the silane blocking layer below. This polymer blend adhesive layer is insoluble in toluene and has a dry thickness of 665 Angstroms.

EXAMPLE XV

The same procedure as described in EXAMPLE XI is followed to prepare a photoconductive imaging member, except that a double layer adhesive consisting of a 189 Angstroms thickness of Vitel PE-100 is first coated over the silane blocking layer (to promote adhesion) and a 486 Angstroms thickness of Makrolon is applied over the Vitel PE-100 as a second coat to form a resulting Makrolon/Vitel PE-100 double layer. The first coat of Vitel PE-100 is coated using 70:30 volume ratio tetrahydrofuran/cyclohexanone, while the second coat is prepared using methylene chloride as solvent.

EXAMPLE XVI

The same procedure as described in EXAMPLE XI is followed to prepare a photoconductive imaging member, except that polystyrene available from Monsanto is used to replace Makrolon as the polymer binder for charge transport layer fabrication.

EXAMPLE XVII

The photoconductive imaging members having adhesive layers which are insensitive to attack by toluene, the solvent used for charge transport layer solutions preparation described in the invention EXAMPLES X through XVI, are evaluated for 180° peel strength and analyzed for charge generating layer mud-cracking by following the same procedures as described in EXAMPLE IX. The results obtained presented in Table II below indicate that selecting an adhesive layer which does not dissolve in toluene coupled with the use of a polymer binder that is compatible with the charge transport molecules and soluble in toluene for charge transport layer solution preparation can eliminate the undesirable charge generating layer mud-cracking problem as well as improve the adhesive layer/charge generating layer bond strength. The improved adhesion strength of the photoconductive imaging members of the present invention should provide greater resistance to layer delamination in a machine service environment.

TABLE II

| EXAMPLE | Peel Strength (gm/cm) | Mud-cracking |
|---|---|---|
| X | 8.7 | No |
| XI | 9.4 | No |
| XII | 10.1 | No |
| XIII | 10.2 | No |
| XIV | 9.8 | No |
| XV | 11 3 | No |
| XVI | 9.2 | No |

EXAMPLE XVIII

The photoconductive imaging members fabricated using the present invention concept as described in EXAMPLES II through VIII and X through XVI along with the control imaging member of COMPARATIVE EXAMPLE I are examined for their electrophotographic performances using a xerographic scanner at 21° C. and 40% relative humidity. The results, after 50,000 cycles of testing, of charge acceptance, dark decay potential, background and residual voltages, photosensitivity, photo-induced discharge characteristics, and long term electrical cyclic stability for all invention imaging members are equivalent to those obtained for the control imaging member counterpart, indicating that the photo-electrical integrity of the original photoconductive imaging member has been maintained.

While the invention has been described with reference to particular preferred embodiments, the invention is not limited to the specific examples given, and other embodiments and modifications can be made by those skilled in the art without departing from the spirit and scope of the invention and the claims.

What is claimed is:

1. An electrophotographic imaging member comprising a charge generating layer contiguous on one side to a charge transport layer and on the other side to an adhesive layer, said charge transport layer being formed by solution coating a material which is soluble in a solvent, said adhesive layer being formed of a film-forming polymer which is substantially insoluble in said solvent and wherein said charge generating layer is resistant to two-dimensional mud-cracking.

2. The imaging member of claim 1, wherein said film-forming polymer is cross-linked.

3. The imaging member of claim 1, wherein said solvent comprises chlorinated solvent.

4. The imaging member of claim 1, wherein said solvent comprises methylene chloride.

5. The imaging member of claim 1, wherein said adhesive layer is comprised of a cross-linked copolyester which is a reaction product of a reactant copolyester having more than two hydroxy functionalities and a cross-linking agent.

6. The imaging member of claim 5, wherein said cross-linking agent is a triisocyanate.

7. The imaging member of claim 5, wherein said reactant copolyester is a short chain branched copolyester.

8. The imaging member of claim 1, wherein said adhesive layer comprises cross-linked polyurethane which is a reaction product of a prepolymer and a cross-linking agent.

9. The imaging member of claim 8, wherein said cross-linked polyurethane is a reaction product of a polyol prepolymer and a diisocyanate.

10. The imaging member of claim 1, wherein said charge generating layer is vacuum sublimation deposited.

11. An electrophotographic imaging member, comprising a supporting substrate having an electrically conductive layer, a charge blocking layer, an adhesive layer, a charge generating layer, and a charge transport layer, said adhesive layer formed from a cross-linked film-forming polymer which is substantially insoluble in methylene chloride and said charge generating layer is resistant to two-dimensional mud-cracking.

12. The imaging member of claim 11, wherein said adhesive layer comprises at least one of a cross-linked copolyester and a cross-linked polyurethane.

13. The imaging member of claim 12, wherein said cross-linked copolyester is a reaction product of a cross-linking agent and a reactant copolyester having more than two hydroxy functionalities.

14. The imaging member of claim 13, wherein said reactant copolyester is a short chain branched copolyester.

15. The imaging member of claim 13, wherein said cross-linking agent is a triisocyanate.

16. The imaging member of claim 12, wherein said polyurethane is a reaction product of a polyol prepolymer and a diisocyanate.

17. The imaging member of claim 11, wherein said charge generating layer is vacuum sublimation deposited.

18. An electrophotographic imaging member comprising a charge blocking layer, an adhesive layer, a charge generating layer, and a charge transport layer, said charge transport layer being applied with a solvent, said adhesive layer formed from a material which is substantially insoluble in said solvent and said charge generating layer being resistant to two-dimensional mud-cracking.

19. The imaging member of claim 18, wherein said charge transport layer comprises an electrically inactive resin material selected from the group consisting of 4,4'-cyclohexylidene diphenyl polycarbonates, polystyrenes, polyarylates, polysilylenes and polyether carbonates.

20. The imaging member of claim 18, wherein said charge generating layer comprises a vacuum sublimation deposited material.

21. The imaging member of claim 20, wherein said charge generating layer comprises at least one of a benzimidazole perylene and a chloro indium phthalocyanine.

22. The imaging member of claim 18, wherein said adhesive layer comprises at least one of a copolyester, a cross-linked copolyester and a cross-linked polyurethane.

23. The imaging member of claim 18, wherein said adhesive layer comprises a copolyester and a polycarbonate.

24. The imaging member of claim 23, wherein said copolyester forms a first layer adjacent said blocking layer, and said polycarbonate forms a second layer on said first layer.

25. A method for producing an electrophotographic imaging member, comprising:

forming at least one lower layer of an electrophotographic imaging member;

coating an adhesive layer on said lower layer;

depositing a charge generating layer on said adhesive layer;

solution coating a two-dimensional mud-crack resistant charge transport layer on said charge generating layer, an inactive resin binder of said charge transport layer being dissolved in a solvent;

said adhesive layer formed from a material which is substantially insoluble in said solvent.

26. The method of claim 25, wherein said adhesive layer comprises at least one of a copolyester, a cross-linked copolyester and a cross-linked polyurethane.

27. The method of claim 26, wherein said cross-linked copolyester is a reaction product of a cross-linking agent and a reactant copolyester having more than two hydroxy functionalities.

28. The method of claim 27, wherein said reactant copolyester is a short chain branched copolyester.

29. The method of claim 28, wherein said cross-linking agent is a triisocyanate.

30. The method of claim 26, wherein said polyurethane is the reaction product of a polyol prepolymer and a diisocyanate.

31. The method of claim 25, wherein said adhesive layer comprises a copolyester and polycarbonate.

32. The method of claim 31, wherein said copolyester forms a first layer adjacent said blocking layer, and said polycarbonate forms a second layer on said first layer.

33. The method of claim 25, wherein said solvent is toluene.

34. The imaging member of claim 1, wherein the adhesive layer is substantially insoluble in any solvent in which the charge transport layer is soluble.

35. The method of claim 25, wherein the charge generating layer is vacuum sublimation deposited on said adhesive layer.

* * * * *